US010655202B2

(12) United States Patent
Inoue et al.

(10) Patent No.: US 10,655,202 B2
(45) Date of Patent: May 19, 2020

(54) METHOD FOR MANUFACTURING ALUMINUM ALLOY MEMBER AND ALUMINUM ALLOY MEMBER MANUFACTURED BY THE SAME

(71) Applicant: MITSUBISHI HEAVY INDUSTRIES, LTD., Tokyo (JP)

(72) Inventors: Akiko Inoue, Tokyo (JP); Takayuki Takahashi, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 290 days.

(21) Appl. No.: 15/313,936

(22) PCT Filed: May 29, 2015

(86) PCT No.: PCT/JP2015/065566
§ 371 (c)(1),
(2) Date: Nov. 23, 2016

(87) PCT Pub. No.: WO2015/182748
PCT Pub. Date: Dec. 3, 2015

(65) Prior Publication Data

US 2017/0183762 A1 Jun. 29, 2017

(30) Foreign Application Priority Data

May 29, 2014 (JP) ..... 2014-111568

(51) Int. Cl.
*C22F 1/053* (2006.01)
*C22C 21/10* (2006.01)
*B21C 23/00* (2006.01)

(52) U.S. Cl.
CPC ..... *C22F 1/053* (2013.01); *B21C 23/002* (2013.01); *C22C 21/10* (2013.01)

(58) Field of Classification Search
None
See application file for complete search history.

(56) References Cited

U.S. PATENT DOCUMENTS 3,945,861 A * 3/1976 Anderson ..... C22F 1/053 148/690
2007/0074791 A1* 4/2007 Yoshida ..... C22C 21/10 148/439

(Continued)

FOREIGN PATENT DOCUMENTS

CN 102676962 A 9/2012
EP 2716780 A1 4/2014

(Continued)

OTHER PUBLICATIONS

English translation of JP 2007-100157 (published Apr. 2007) from Espacenet.*

(Continued)

*Primary Examiner* — George Wyszomierski
(74) *Attorney, Agent, or Firm* — Hauptman Ham, LLP

(57) ABSTRACT

The method for manufacturing an aluminum alloy member includes a forming step to heat an aluminum (Al) alloy containing magnesium (Mg) at 1.6% by mass or more and 2.6% by mass or less, zinc (Zn) at 6.0% by mass or more and 7.0% by mass or less, copper (Cu) or silver (Ag) at 0.5% by mass or less provided that a total amount of copper (Cu) and silver (Ag) is 0.5% by mass or less, titanium (Ti) at 0.01% by mass or more and 0.05% by mass or less, and aluminum (Al) and inevitable impurities as the remainder at 400° C. or higher and 500° C. or lower and to form the aluminum alloy and a cooling step to cool the formed aluminum alloy at a cooling speed of 2° C./sec or more and 30° C./sec or less and preferably 2° C./sec or more and 10° C./sec or less.

5 Claims, 2 Drawing Sheets

(56) References Cited

U.S. PATENT DOCUMENTS

| | | | | |
|---|---|---|---|---|
| 2012/0234440 | A1 | 9/2012 | Miyata et al. | |
| 2013/0146183 | A1 | 6/2013 | Miyata et al. | |
| 2014/0209222 | A1* | 7/2014 | Shikama | C22C 21/10 148/695 |
| 2015/0218677 | A1* | 8/2015 | Aruga | C22C 21/10 420/532 |
| 2015/0218679 | A1* | 8/2015 | Aruga | C22C 21/10 420/532 |
| 2017/0275739 | A1* | 9/2017 | Inoue | C22F 1/053 |

FOREIGN PATENT DOCUMENTS

| | | | |
|---|---|---|---|
| JP | 2007-100157 | A | 4/2007 |
| JP | 2011-241449 | A | 12/2011 |
| JP | 2012-207302 | A | 10/2012 |
| JP | 2012-246555 | A | 12/2012 |
| WO | 2012/165086 | A1 | 12/2012 |
| WO | 2014/046046 | A1 | 3/2014 |

OTHER PUBLICATIONS

Written Opinion in International Application No. PCT/JP2015/065566, dated Aug. 18, 2015.
Office Action in CN Application No. 201580025637.9, dated Aug. 1, 2017. 11pp.
International Search Report in PCT/JP2015/065566, dated Aug. 18, 2015.
Extended European Search Report in EP Application No. 15799459.1, dated May 8, 2017.

* cited by examiner

METHOD FOR MANUFACTURING ALUMINUM ALLOY MEMBER AND ALUMINUM ALLOY MEMBER MANUFACTURED BY THE SAME

RELATED APPLICATIONS

The present application is a National Phase of International Application Number PCT/JP2015/065566, filed on May 29, 2015, which claims priority to Japanese Patent Application Number 2014-111568, filed on May 29, 2014.

FIELD

The present invention relates to a method for manufacturing an aluminum alloy member and an aluminum alloy member, in particular, it relates to a method for manufacturing an aluminum alloy member by which an aluminum alloy member having an excellent shape accuracy is obtained and an aluminum alloy member manufactured by the same.

BACKGROUND

Hitherto, in the structural members for motor vehicles, aircrafts, and the like, Al—Cu-based JIS 2000 series aluminum alloys and Al—Cu—Mg—Zn-based JIS 7000 series aluminum alloys capable of having a high proof stress and a high strength are used (for example, see Patent Literature 1). In order to improve the formability of these aluminum alloys at the time of bending and the like, the aluminum alloy members for structural members are manufactured by conducting hot forming to form the aluminum alloy by decreasing the rigidity while heating it or W forming to form the aluminum alloy by softening it through a heat treatment (solution heat treatment) and then enhancing the strength again through a heat treatment (aging treatment).

CITATION LIST

Patent Literature

Patent Literature 1: Japanese Laid-open Patent Publication No. 2011-241449

SUMMARY

Technical Problem

However, in the method for manufacturing an aluminum alloy member of the prior art, there is a case in which natural aging proceeds at the time of maintaining the aluminum alloy at normal temperature after the solution heat treatment through a heat treatment until forming. In this case, the rigidity of the aluminum alloy before forming gradually increases. Hence, in the method for manufacturing an aluminum alloy member of the prior art, there is a case in which the load required for forming increases by natural aging of the aluminum alloy. In addition, there is a case in which the deformation of the aluminum alloy due to spring-back based on the residual stress that is generated in the inside of the aluminum alloy by cooling after the solution heat treatment is likely to be caused so that a desired shape accuracy is not obtained after forming.

In addition, a method for manufacturing an aluminum alloy member by using an aluminum alloy exhibiting favorable formability at room temperature or by the T5 treatment to increase the strength through only artificial aging with forming the solute atom into a solid solution to utilize the heat generated during the extrusion forming without conducting the solution heat treatment is also been investigated. However, even in these cases, there is a case in which a sufficient strength is not obtained as compared to the case of using the JIS 7000 series and JIS 2000 series aluminum alloys.

The present invention has been made in view of such circumstances, and an object thereof is to provide a method for manufacturing an aluminum alloy member which makes it possible to manufacture an aluminum alloy member having a high strength, a high proof stress, and an excellent shape accuracy and an aluminum alloy member manufactured by the same.

Solution to Problem

A method for manufacturing an aluminum alloy member in this invention comprises a forming step to heat an aluminum (Al) alloy containing magnesium (Mg) at 1.6% by mass or more and 2.6% by mass or less, zinc (Zn) at 6.0% by mass or more and 7.0% by mass or less, copper (Cu) or silver (Ag) at 0.5% by mass or less, wherein a total amount of copper (Cu) and silver (Ag) is 0.5% by mass or less, titanium (Ti) at 0.01% by mass or more and 0.05% by mass or less, and aluminum (Al) and inevitable impurities as the remainder at 400° C. or higher and 500° C. or lower and to form the aluminum alloy; and a cooling step to cool the formed aluminum alloy at a cooling speed of 2° C./sec or more and 30° C./sec or less to obtain an aluminum alloy member.

According to this method for manufacturing an aluminum alloy member, it is possible to form an aluminum alloy without conducting a solution heat treatment since the aluminum alloy contains magnesium, zinc, and copper or silver in predetermined amounts so that the formability thereof is improved. Moreover, it is possible to enhance the strength of the aluminum alloy member since titanium has an effect of refining the crystal grains of the molten metal. This aluminum alloy can maintain a high strength and a high proof stress even when being cooled at a cooling speed of 30° C./sec or less at the time of cooling after forming, and thus it is possible to prevent the occurrence of thermal distortion or residual stress associated with cooling and to prevent a decrease in shape accuracy at the time of forming. Consequently, it is possible to realize a method for manufacturing an aluminum alloy member which makes it possible to manufacture an aluminum alloy member having a high strength, a high proof stress, and excellent shape accuracy.

According to the method for manufacturing an aluminum alloy member in the embodiment, the aluminum alloy contains one kind or two or more kinds among manganese (Mn), chromium (Cr), and zirconium (Zr) at 0.15% by mass or more and 0.6% by mass or less in total. By this configuration, coarsening of crystal grains of the aluminum alloy is suppressed and an effect of enhancing the strength, the resistance to stress corrosion cracking, and the fatigue life is obtained.

According to the method for manufacturing an aluminum alloy member in this invention, the method further includes an aging treatment step to age the aluminum alloy member by maintaining the aluminum alloy member under a condition of 100° C. or higher and 200° C. or lower. By this method, the precipitate is produced on the aluminum alloy and the strength of the aluminum alloy is enhanced.

According to the method for manufacturing an aluminum alloy member in this invention, the aluminum alloy member is aged for two hours or longer in the aging treatment step. By this method, the strength of the aluminum alloy is enhanced through aging.

According to the method for manufacturing an aluminum alloy member in this invention, the aluminum alloy is air-cooled in the cooling step. By this method, it is possible to easily and inexpensively cool the aluminum alloy.

An aluminum alloy member in this invention is obtained by the method for manufacturing an aluminum alloy member.

This aluminum alloy member is manufactured by using an aluminum alloy containing magnesium, zinc, copper or silver, and titanium in predetermined amounts, and thus the formability of aluminum alloy is improved and it is possible to form the aluminum alloy without conducting a solution heat treatment. Moreover, this aluminum alloy can maintain a high strength and a high proof stress even when being cooled at a cooling speed of 30° C./sec or less at the time of cooling after forming, and thus it is possible to prevent the occurrence of thermal distortion or residual stress associated with cooling and to prevent a decrease in shape accuracy at the time of forming. Consequently, it is possible to realize an aluminum alloy member which has a high strength, a high proof stress, and excellent shape accuracy.

Advantageous Effects of Invention

According to the present invention, it is possible to realize a method for manufacturing an aluminum alloy member which makes it possible to manufacture an aluminum alloy member having a high strength, a high proof stress, and an excellent shape accuracy and an aluminum alloy member manufactured by the same.

DESCRIPTION OF EMBODIMENTS

As structural members for motor vehicles, aircrafts, and the like, aluminum alloys such as JIS 7000 series aluminum alloys which have an excellent specific strength are widely used. In such an aluminum alloy, the W treatment or solution heat treatment to soften the aluminum alloy by subjecting it to a heat treatment at a predetermined temperature before forming (or after forming) is required in order to obtain sufficient formability and a sufficient shape accuracy. It is required to quench (for example, 30° C./sec or more) the aluminum alloy after the solution heat treatment in order to obtain a sufficient strength.

The present inventors have found out that, by hot forming an aluminum alloy having a predetermined composition, it is possible not only to obtain sufficient formability and a sufficient shape accuracy but also to prevent a decrease in strength of the aluminum alloy even when the aluminum alloy after forming is cooled, thereby completing the present invention.

Hereinafter, an embodiment of the present invention will be described in detail with reference to the accompanying drawings. Incidentally, the present invention is not limited to the following embodiments and can be implemented with appropriate modifications. Incidentally, an aluminum alloy member of an extruded material to be manufactured by hot-extruding an aluminum alloy ingot will be described as an example in the following description. However, the present invention can also be applied to the manufacture of an aluminum alloy member of a rolled plate to be manufactured by hot-rolling and hot-pressing an ingot.

Figure 1:
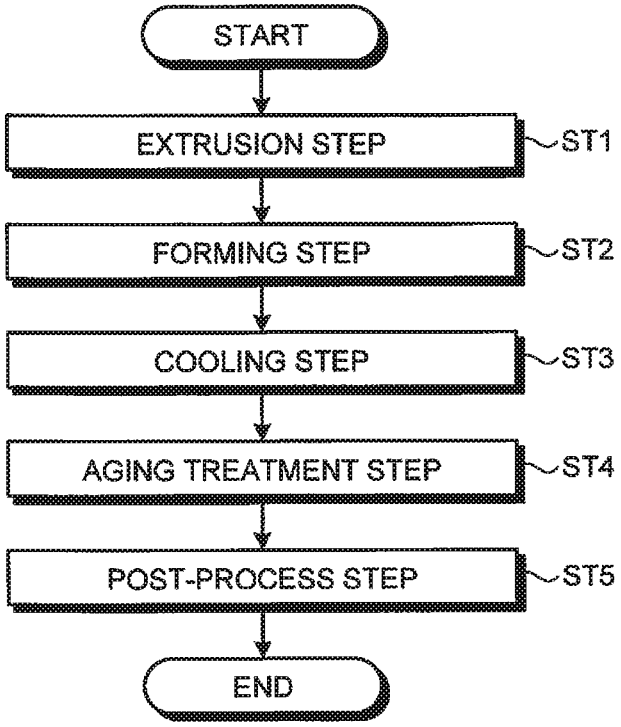
FIG. 1 is a flow diagram of the method for manufacturing an aluminum alloy member according to an embodiment of the present invention.

FIG. 1 is a flow diagram of the method for manufacturing an aluminum alloy member according to an embodiment of the present invention. As illustrated in FIG. 1, the method for manufacturing an aluminum alloy member according to the present embodiment includes an extrusion step ST1 to heat an aluminum (Al) alloy containing magnesium (Mg) at 1.6% by mass or more and 2.6% by mass or less, zinc (Zn) at 6.0% by mass or more and 7.0% by mass or less, copper (Cu) or silver (Ag) at 0.5% by mass or less provided that a total amount of copper (Cu) and silver (Ag) is 0.5% by mass or less, titanium (Ti) at 0.01% by mass or more and 0.05% by mass or less, and aluminum (Al) and inevitable impurities as the remainder at 400° C. or higher and 500° C. or lower and to extrude it from a pressure resistant mold, a forming step ST2 to form the aluminum alloy extruded from the mold to a desired shape, a cooling step ST3 to cool the formed aluminum alloy at a cooling speed of 2° C./sec or more and 30° C./sec or less and preferably 2° C./sec or more and 10° C./sec or less to obtain an aluminum alloy member, an aging treatment step ST4 to age the cooled aluminum alloy member by maintaining it at 100° C. or higher and 200° C. or lower, and a post-process step ST5 to subject the aged aluminum alloy member to a surface treatment and coating.

Incidentally, in the example illustrated in FIG. 1, an example in which the extrusion step ST1 is carried out before the forming step ST2 is described. However, it is not required to always carry out the extrusion step ST1 as long as it is possible to carry out the forming step ST2 by heating the aluminum alloy at 400° C. or higher and 500° C. or lower and hot-forming it. In addition, in the example illustrated in FIG. 1, an example in which the aging treatment step ST4 and the post-process step ST5 are carried out after the cooling step ST3 is described. However, the aging treatment step ST4 and post-process step ST5 may be carried out if necessary. Hereinafter, the aluminum alloy to be used in the method for manufacturing an aluminum alloy member according to the present embodiment will be described in detail.

(Aluminum Alloy)

As the aluminum alloy, 7000 series aluminum alloys (hereinafter, simply referred to as the "7000 series aluminum alloy") having an Al—Zn—Mg-based composition and an Al—Zn—Mg—Cu-based composition including the JIS standard and the AA standard are used. By using this 7000 series aluminum alloy, it is possible to obtain an aluminum alloy member having a high strength so that the strength is 400 MPa or higher as a 0.2% proof stress, for example, by subjecting the aluminum alloy to an artificial aging treatment under the conditions of 120° C. or higher and 160° C. or lower in six hours or longer and 16 hours or shorter in the T5 to T7.

As the aluminum alloy, one that has a composition consisting of magnesium (Mg) at 1.6% by mass or more and 2.6% by mass or less, zinc (Zn) at 6.0% by mass or more and 7.0% by mass or less, copper (Cu) or silver (Ag) at 0.5% by mass or less provided that a total amount of copper (Cu) and silver (Ag) is 0.5% by mass or less, titanium (Ti) at 0.01% by mass or more and 0.05% by mass or less, and aluminum (Al) and inevitable impurities as the remainder is used. By using an aluminum alloy having such a composition, it is possible to obtain strength of the aluminum alloy member of 400 MPa or higher as a 0.2% proof stress. In addition, it is preferable that the aluminum alloy contains one kind or two or more kinds among manganese (Mn), chromium (Cr), and zirconium (Zr) at 0.15% by mass or more and 0.6% by mass or less in total.

Titanium (Ti) forms $Al_3Ti$ at the time of casting the aluminum alloy and has an effect of refining the crystal grains, and thus it is preferable that titanium is 0.01% by mass or more with respect to the total mass of the aluminum alloy. In addition, the resistance of the aluminum alloy member to stress corrosion cracking is enhanced when titanium is 0.05% by mass or less. The content of titanium is preferably 0.01% by mass or more and 0.05% by mass or less.

Magnesium (Mg) is an element to enhance the strength of the aluminum alloy member. The content of magnesium (Mg) is 1.6% by mass or more with respect to the total mass of the aluminum alloy from the viewpoint of enhancing the strength of the aluminum alloy member. The content of magnesium (Mg) is 2.6% by mass or less and preferably 1.9% by mass or less from the viewpoint of improving the productivity of the extruded material such as a decrease in extrusion pressure during extrusion and improvement in extrusion speed. In consideration of the description above, the content of magnesium (Mg) is in a range of 1.6% by mass or more and 2.6% by mass or less and preferably in a range of 1.6% by mass or more and 1.9% by mass or less with respect to the total mass of the aluminum alloy.

Zinc (Zn) is an element to enhance the strength of the aluminum alloy member. The content of zinc (Zn) is 6.0% by mass or more and preferably 6.4% by mass or more with respect to the total mass of the aluminum alloy from the viewpoint of enhancing the strength of the aluminum alloy member. The content of zinc (Zn) is 7.0% by mass or less from the viewpoint of decreasing a grain boundary precipitate $MgZn_2$ and enhancing the resistance of the aluminum alloy member to stress corrosion cracking. In consideration of the description above, the content of zinc (Zn) is in a range of 6.0% by mass or more and 7.0% by mass or less and preferably in a range of 6.4% by mass or more and 7.0% by mass or less with respect to the total mass of the aluminum alloy.

Copper (Cu) is an element to enhance the strength of the aluminum alloy member and the resistance thereof to stress corrosion cracking (SCC). The content of copper (Cu) is 0% by mass or more and 0.5% by mass or less with respect to the total mass of the aluminum alloy from the viewpoint of enhancing the strength of the aluminum alloy member and the resistance thereof to stress corrosion cracking (SCC) and from the viewpoint of extrusion formability. Incidentally, the same effect is obtained even when a part or the whole of copper (Cu) is changed to silver (Ag).

Zirconium (Zr) is preferably 0.15% by mass or more with respect to the total mass of the aluminum alloy from the viewpoint of obtaining an effect of enhancing the strength of the aluminum alloy or preventing the recovery recrystallization through the formation of $Al_3Zr$ and enhancing the resistance to stress corrosion cracking so as to suppress coarsening of crystal grains and from the viewpoint of improving crack initiation property and fatigue life so as to form a fiber structure. In addition, hardening sensitivity is not sharp and the strength is enhanced when zirconium is 0.6% by mass or less. The content of zirconium (Zr) is preferably 0.15% by mass or more and 0.6% by mass or less with respect to the total mass of the aluminum alloy. In addition, the same effect is obtained even when a part or the entire amount of zirconium (Zr) is replaced with chromium (Cr) or manganese (Mn), and thus the total amount of (Zr, Mn, and Cr) contained may be 0.15% by mass or more and 0.6% by mass or less.

Examples of the inevitable impurities may include iron (Fe) and silicon (Si) or the other which are unavoidably mixed from the base metal and scrap of the aluminum alloy. It is preferable to set the content of the inevitable impurities such that the content of iron (Fe) is 0.25% by mass or less and the content of silicon (Si) is 0.05% by mass or less from the viewpoint of maintaining the properties as a product, such as formability, corrosion resistance, and weldability of the aluminum alloy member.

<Extrusion Step: ST1>

In the extrusion step, the aluminum alloy adjusted to the composition range described above is melted and then cast into an ingot (billet) by a melt casting method such as a semi-continuous casting method (DC casting method). Next, the ingot of cast aluminum alloy is heated in a predetermined temperature range (for example, 400° C. or higher and 500° C. or lower) for the homogenization heat treatment (soaking). This eliminates segregation or the like in the crystal grains in the aluminum alloy ingot and the strength of the aluminum alloy member is enhanced. The heating time is, for example, two hours or longer. Next, the homogenized aluminum alloy ingot is hot-extruded from the pressure resistant mold in a predetermined temperature range (for example, 400° C. or higher and 500° C. or lower).

<Forming Step: ST2>

In the forming step, the extruded aluminum alloy is formed in a temperature range of 400° C. or higher and 500° C. or lower. In addition, the forming may be simultaneously conducted with the hot extrusion from the mold in the extrusion step, or it may be conducted in a state of maintaining the aluminum alloy after the extrusion step in a temperature range of 400° C. or higher and 500° C. or lower.

The forming is not particularly limited as long as the aluminum alloy can be formed into a desired shape of the aluminum alloy member. Examples of the forming may include plastic processing accompanied by the occurrence of residual stress such as the entire or partial bending of the extruded material of the aluminum alloy in the longitudinal direction, partial crushing of the cross section of the extruded material, punching of the extruded material, and trimming of the extruded material. Only one kind of these formings may be conducted or two or more kinds thereof may be conducted.

<Cooling Step: ST3>

In the cooling step, the aluminum alloy formed into a desired shape is cooled at a cooling speed of 2° C./sec or more and 30° C./sec or less and preferably 2° C./sec or more and 10° C./sec or less. The temperature after cooling in the cooling step is, for example, 250° C. or lower. By cooling the aluminum alloy at such a cooling speed, it is possible to eliminate the residual stress generated inside the aluminum alloy by forming in the forming step and thus the shape accuracy of the aluminum alloy member is improved. Furthermore, in the present embodiment, it is possible to manufacture an aluminum alloy member having a high strength even in the case of cooling the aluminum alloy at a cooling speed of 2° C./sec or more and 30° C./sec or less and preferably 2° C./sec or more and 10° C./sec or less as an aluminum alloy having the composition described above is used.

Figure 2:
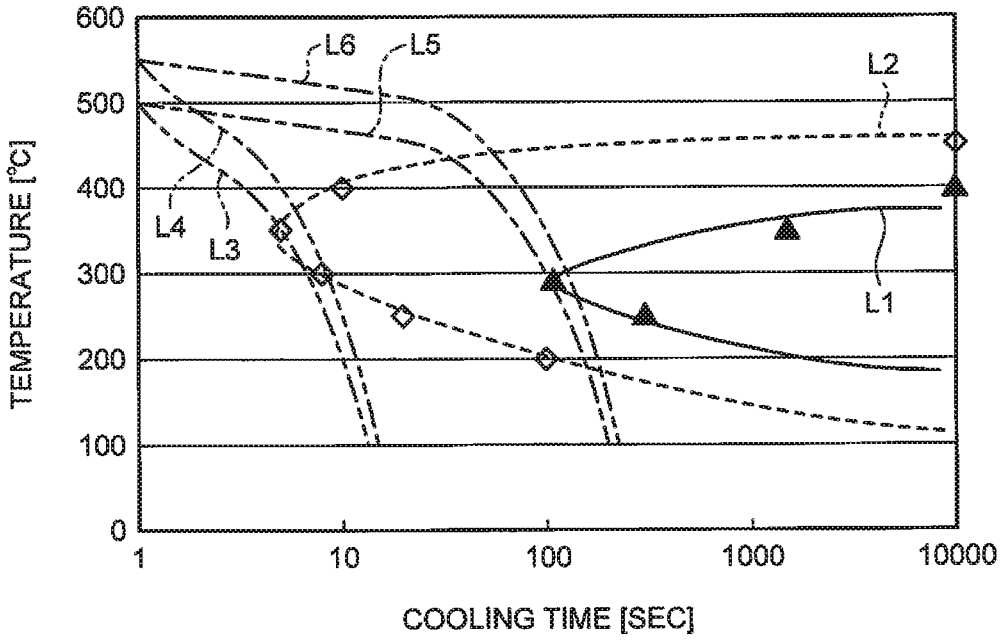
FIG. 2 is a diagram illustrating the relation between the cooling temperature and the cooling time of the aluminum alloy according to an embodiment of the present invention and a general aluminum alloy.

Here, the relation between the cooling conditions in the cooling step and the strength of the aluminum alloy according to the present embodiment will be described in detail with reference to FIG. 2. FIG. 2 is a diagram illustrating the relation between the cooling temperature and the cooling time of the aluminum alloy according to the present embodiment and a general aluminum alloy. Incidentally, in FIG. 2, the cooling time is illustrated on the horizontal axis and the temperature of the aluminum alloy is illustrated on the vertical axis. In addition, the range indicating the relation between the cooling temperature and the cooling time which make it possible to enhance the strength of the aluminum alloy according to the present embodiment is illustrated in the outer region (left side) of the solid curve L1. The range indicating the relation between the cooling temperature and the cooling time which make it possible to enhance the strength of a general aluminum alloy is illustrated in the outer region (left side) of the dashed curve L2. Furthermore, the cooling curves L5 and L6 when the aluminum alloy is cooled from 500° C. and 550° C. at a cooling speed of 2° C./sec are illustrated as a long dashed short dashed line, respectively, and the cooling curves L3 and L4 when the aluminum alloy is cooled from 500° C. and 550° C. at a cooling speed of 30° C./sec are illustrated as a long dashed double-short dashed line, respectively.

As illustrated in FIG. 2, in the aluminum alloy according to the present embodiment, in the case of cooling the aluminum alloy at a cooling speed of 30° C./sec, the cooling curves L3 and L4 are present in the outer region (left side) of the solid curve L1 in both cases of cooling the aluminum alloy from the temperatures of 500° C. and 550° C. From this result, it can be seen that it is possible to prevent a decrease in strength of the aluminum alloy in the case of quenching the aluminum alloy at a cooling speed of 30° C./sec in the aluminum alloy according to the present embodiment.

In addition, in the aluminum alloy according to the present embodiment, in the case of cooling the aluminum alloy at a cooling speed of 2° C./sec, the cooling curve L6 passes through the inner region (right side) of the solid curve L1 in the case of cooling the aluminum alloy from 550° C. Besides, the cooling curve L5 passes over the solid curve L1 without entering the inner side (right side) of the solid curve L1 in the case of cooling the aluminum alloy from 500° C. From this result, in the aluminum alloy according to the present embodiment, it is not required to quench the aluminum alloy under a condition of 30° C./sec of a cooling speed at which the residual stress remains inside the aluminum alloy, but it is possible to obtain an aluminum alloy having a high strength even in the case of cooling the aluminum alloy at 500° C. under a condition of 2° C./sec of a cooling speed at which the residual stress inside the aluminum alloy is eliminated. By this, in the present embodiment, it can be seen that not only an aluminum alloy having a high strength is obtained but also it is possible to prevent a decrease in shape accuracy of the aluminum alloy member based on the residual stress inside the aluminum alloy generated in the forming step.

On the other hand, in cases of heating the aluminum alloy and cooling it from 500° C. and 550° C. in the same manner as above by using a general aluminum alloy, the cooling curves L3 to L6 pass through the inner side (right side) of the dashed curve L2 when the aluminum alloy is cooled at both cooling velocities of 2° C./sec and 30° C./sec. Hence, in the case of manufacturing an aluminum alloy having a high strength by using a general aluminum alloy, it is required to quench the aluminum alloy at a cooling speed of 30° C./sec or more and it is impossible to eliminate the residual stress of the aluminum alloy. In addition, in the case of cooling the aluminum alloy at a cooling speed of 30° C./sec or less by using a general aluminum alloy, there is a possibility that the residual stress inside the aluminum alloy is eliminated but it is impossible to obtain an aluminum alloy having a high strength.

As described above, an aluminum alloy having a predetermined composition is used in the method for manufacturing an aluminum alloy member according to the present embodiment, and thus it is possible to manufacture an aluminum alloy having a high strength even in a case in which the residual stress is eliminated by cooling the aluminum alloy at a cooling speed of 2° C./sec after hot forming. Consequently, it is possible to realize a method for manufacturing an aluminum alloy member which makes it possible to easily manufacture an aluminum alloy member having a high strength without conducting a solution heat treatment and an aluminum alloy member.

The cooling speed of the aluminum alloy in the cooling step is 2° C./sec or more and 30° C./sec or less and preferably 2° C./sec or more and 10° C./sec or less as described above. It is possible to prevent a decrease in strength of the aluminum alloy as illustrated in FIG. 2 when the cooling speed is 2° C./sec or more. It is possible to sufficiently eliminate the thermal distortion and residual stress inside the aluminum alloy when the cooling speed is 10° C./sec or less, and thus the shape accuracy of the aluminum alloy member is improved. The cooling speed of the aluminum alloy is more preferably 3° C./sec or more and even more preferably 4° C./sec or more and more preferably 9° C./sec or less and even more preferably 8° C./sec or less from the viewpoint of further improving the effect described above.

In the cooling step, it is preferable to air-cool the aluminum alloy. This makes it possible to easily and inexpensively cool the aluminum alloy. The conditions for air cooling are not particularly limited as long as the cooling speed is 2° C./sec or more and 30° C./sec or less and preferably 2° C./sec or more and 10° C./sec or less. As the conditions for air cooling, for example, the aluminum alloy may be left to stand in an environment of normal temperature (−10° C. or higher and 50° C. or lower) or the aluminum alloy left to stand in an environment of normal temperature may be cooled by blowing air thereto.

<Aging Treatment Step: ST4>

In the aging treatment step, the aluminum alloy member is maintained by a heat treatment (for example, 100° C. or higher and 200° C. or lower) for the aging treatment. By this, a change in rigidity of the aluminum alloy due to natural aging decreases and the aluminum alloy is stabilized, and thus the shape accuracy of the aluminum alloy member is improved. The temperature for the aging treatment is preferably 100° C. or higher and more preferably 125° C. or higher and preferably 200° C. or lower and more preferably 175° C. or lower from the viewpoint of the strength of the aluminum alloy member.

The time for the aging treatment is preferably two hours or longer. By this, the precipitation of aluminum alloy by the aging treatment occurs, and thus the strength of the aluminum alloy member is enhanced. The time for the aging treatment is more preferably six hours or longer and preferably 48 hours or shorter and more preferably 24 hours or shorter.

<Post-Process Step: ST5>

In the post-process step, the cooled aluminum alloy member is subjected to a surface treatment and coating from the viewpoint of improving the corrosion resistance, abrasion resistance, decorativeness, light antireflection properties, conductivity, thickness uniformity, and workability thereof. Examples of the surface treatment may include an alumite treatment, a chromate treatment, a non-chromate treatment, an electrolytic plating treatment, an electroless plating treatment, chemical polishing, and electrolytic polishing.

As described above, according to the method for manufacturing an aluminum alloy member according to the present embodiment, the aluminum alloy contains magnesium, zinc, and copper or silver in predetermined amounts, and thus it is possible to form an aluminum alloy having a high strength without conducting a solution heat treatment. Moreover, it is possible to prevent the recrystallization organization of the surface and coarsening of the crystal grains of the processed structure inside the aluminum alloy and to maintain a high strength even when this aluminum alloy is cooled at a cooling speed of 30° C./sec or less and preferably 10° C./sec or less at the time of cooling after forming. Thus it is possible to prevent the occurrence of thermal strain and residual stress associated with cooling. This makes it possible to manufacture an aluminum alloy having a 0.2% proof stress of 430 MPa or more, a tensile strength of 500 MPa or more, and high shape accuracy.

EXAMPLES

Hereinafter, the present invention will be described in more detail with reference to Examples which are carried out in order to clarify the effect of the present invention. The present invention is not limited to the following Examples in any way.

Example 1

An aluminum (Al) alloy containing magnesium (Mg) at 1.68% by mass, zinc (Zn) at 6.70% by mass, copper (Cu) at 0.26% by mass, titanium (Ti) at 0.02% by mass, manganese (Mn) at 0.25% by mass, and zirconium (Zr) at 0.19% by mass was extruded and formed by a heat treatment at 500° C. Thereafter, the formed aluminum alloy was cooled to 100° C. at a cooling speed of 2.45° C./sec, thereby manufacturing an aluminum alloy member. Thereafter, the tensile strength and proof stress were measured in conformity with the metal material test method regulated in ASTM E557 by using a plate tensile test specimen of American Society for Testing and Materials' Standard ASTM E557 sampled from an arbitrary position of the aluminum alloy member thus manufactured. As a result, the 0.2% proof stress was 492 MPa, and the tensile strength was 531 MPa. Incidentally, these measured values are the average of the measured values of the three sampled specimens in each example. The results are presented in the following Table 1.

Comparative Example 1

An aluminum (Al) alloy containing magnesium (Mg) at 1.68% by mass, zinc (Zn) at 6.70% by mass, copper (Cu) at 0.26% by mass, titanium (Ti) at 0.02% by mass, manganese (Mn) at 0.25% by mass, and zirconium (Zr) at 0.19% by mass was extruded and formed by a heat treatment at 500° C. Thereafter, the formed aluminum alloy was cooled to 200° C. at a cooling speed of 0.36° C./sec, thereby manufacturing an aluminum alloy member. Thereafter, the tensile strength and proof stress were measured in conformity with the metal material test method regulated in ASTM E557 by using a plate tensile test specimen of American Society for Testing and Materials' Standard ASTM E557 sampled from an arbitrary position of the aluminum alloy member thus manufactured. As a result, the 0.2% proof stress was 393 MPa, and the tensile strength was 467 MPa. Incidentally, these measured values are the average of the measured values of the three sampled specimens in each example. The results are presented in the following Table 1.

Comparative Example 2

An aluminum alloy member was manufactured and evaluated in the same manner as in Example 1 except that a commercially available 7000 series aluminum alloy (content of magnesium (Mg): 2.5% by mass, content of zinc (Zn): 5.5% by mass, and content of copper (Cu): 1.6% by mass) was used and the aluminum alloy was cooled from 466° C. to 100° C. at 35° C./sec. As a result, the 0.2% proof stress was 466 MPa, and the tensile strength was 532 MPa. This result is believed to be due to a decrease in thermal stability of the aluminum alloy since an aluminum alloy having a composition different from that in Example 1 was used. The results are presented in the following Table 1.

Comparative Example 3

An aluminum alloy member was manufactured and evaluated in the same manner as in Example 1 except that a commercially available 7000 series aluminum alloy (content of magnesium (Mg): 2.5% by mass, content of zinc (Zn): 5.5% by mass, and content of copper (Cu): 1.6% by mass) was used and the aluminum alloy was cooled from 400° C. to 100° C. at 2.43° C./sec. As a result, the 0.2% proof stress was 230 MPa, and the tensile strength was 352 MPa. This result is believed to be due to a decrease in thermal stability of the aluminum alloy since an aluminum alloy having a composition different from that in Example 1 was used. The results are presented in the following Table 1.

TABLE 1

| | Content (% by mass) | | | | Cooling velocity | Proof stress | Tensile strength |
|---|---|---|---|---|---|---|---|
| | Mg | Zn | Cu | Ti | (° C./sec) | (MPa) | (MPa) |
| Example 1 | 1.68 | 6.7 | 0.26 | 0.02 | 2.43 | 492 | 531 |
| Comparative Example 1 | 1.68 | 6.7 | 0.26 | 0.02 | 0.36 | 393 | 467 |
| Comparative Example 2 | 2.5 | 5.5 | 1.5 | — | 35 | 466 | 532 |
| Comparative Example 3 | 2.5 | 5.5 | 1.5 | — | 2.43 | 230 | 352 |

As can be seen from Table 1, according to the method for manufacturing an aluminum alloy member according to the present embodiment, it can be seen that an aluminum alloy having an excellent 0.2% proof stress and an excellent tensile strength is obtained (Example 1). In contrast, it can be seen that the 0.2% proof stress and the tensile strength decrease in cases in which the cooling speed is too fast and too slow (Comparative Example 1 and Comparative Example 2). In addition, it can be seen that the 0.2% proof stress and the tensile strength decrease in a case in which the composition of the aluminum alloy is out of the range of the aluminum alloy according to the present embodiment as well (Comparative Example 2 and Comparative Example 3).

The invention claimed is:

1. A method for manufacturing an aluminum alloy member comprising:

a heating step of heating an aluminum (Al) alloy containing magnesium (Mg) at 1.6% by mass or more and 2.6% by mass or less, zinc (Zn) at 6.0% by mass or more and 7.0% by mass or less, copper (Cu) or silver (Ag) at 0.5% by mass or less, wherein a total amount of copper (Cu) and silver (Ag) is 0.5% by mass or less, titanium (Ti) at 0.01% by mass or more and 0.05% by mass or less, and aluminum (Al) and inevitable impurities as a remainder at a temperature range of 400° C. or higher and 500° C. or lower;

an extrusion step of hot-extruding the aluminum alloy at the temperature range, a forming step to physically form the aluminum alloy extruded in the extrusion step into a desired shape at the temperature range; and a cooling step to cool the formed aluminum alloy at a cooling speed of 4° C./sec or more and 8° C./sec or less to obtain the aluminum alloy member, wherein, the forming step comprises at least one of bending, crushing, punching, or trimming the extruded aluminum alloy.

2. The method for manufacturing the aluminum alloy member according to claim 1, wherein the aluminum alloy contains at least one selected from the group consisting of manganese (Mn), chromium (Cr), and zirconium (Zr) at 0.15% by mass or more and 0.6% by mass or less in total.

3. The method for manufacturing the aluminum alloy member according to claim 1, further comprising an aging treatment step to age the aluminum alloy member by maintaining the aluminum alloy member under a condition of 100° C. or higher and 200° C. or lower.

4. The method for manufacturing the aluminum alloy member according to claim 3, wherein the aluminum alloy member is aged for two hours or longer in the aging treatment step.

5. The method for manufacturing the aluminum alloy member according to claim 1, wherein the aluminum alloy is air-cooled in the cooling step.

* * * * *